US007232237B2

(12) United States Patent
Bigger

(10) Patent No.: US 7,232,237 B2
(45) Date of Patent: Jun. 19, 2007

(54) ILLUMINATED CONTAINER HOLDER

(76) Inventor: George S. Bigger, 520 W. Midway Blvd., Broomfield, CO (US) 80020-1955

( * ) Notice: Subject to any disclaimer, the term of this patent is extended or adjusted under 35 U.S.C. 154(b) by 33 days.

(21) Appl. No.: 11/070,532

(22) Filed: Mar. 1, 2005

(65) Prior Publication Data

US 2005/0195590 A1 Sep. 8, 2005

Related U.S. Application Data

(60) Provisional application No. 60/549,179, filed on Mar. 2, 2004.

(51) Int. Cl.
*F21V 33/00* (2006.01)

(52) U.S. Cl. ..... 362/154; 362/101

(58) Field of Classification Search ..... 362/101, 362/96, 154, 562; 40/546, 562.02, 540, 538; 248/309.1

See application file for complete search history.

(56) References Cited

U.S. PATENT DOCUMENTS

| | | | | |
|---|---|---|---|---|
| 2,745,947 | A | 5/1956 | Sansous | |
| 4,163,374 | A | 8/1979 | Moore et al. | |
| 4,390,928 | A | 6/1983 | Runge | |
| 4,754,379 | A | 6/1988 | Kelley | |
| 4,886,183 | A | 12/1989 | Fleming | |
| 4,922,355 | A | 5/1990 | Dietz et al. | |
| 5,010,461 | A | 4/1991 | Saotome | |
| 5,119,279 | A | 6/1992 | Makowsky | |
| 5,211,699 | A | 5/1993 | Tipton | |
| 5,259,529 | A | 11/1993 | Coale | |
| 5,671,998 | A | 9/1997 | Collet | |
| 5,785,407 | A | 7/1998 | Ratcliffe et al. | |
| 5,915,832 | A | 6/1999 | Baird, Sr. | |
| 5,990,790 | A | 11/1999 | Lusareta | |
| 6,092,905 | A | 7/2000 | Koehn | |
| 6,163,248 | A | 12/2000 | Paek et al. | |
| 6,174,066 | B1 * | 1/2001 | Vinding-Diers | 362/96 |
| 6,213,616 | B1 | 4/2001 | Chien | |
| 6,234,439 | B1 * | 5/2001 | Townsend et al. | 248/311.2 |
| 6,254,247 | B1 | 7/2001 | Carson | |
| 6,286,719 | B1 | 9/2001 | Haines | |
| 6,305,817 | B1 | 10/2001 | Johnston et al. | |

(Continued)

FOREIGN PATENT DOCUMENTS

| | | |
|---|---|---|
| WO | WO 01/74204 A2 | 10/2001 |

*Primary Examiner*—Ali Alavi
(74) *Attorney, Agent, or Firm*—Advantia Law Group; Michael W. Starkweather; Jason P. Webb

(57) ABSTRACT

The present invention is an illuminated container holder for displaying messages and having an upper retainer, a lower retainer, a base, and a handle. The upper and lower retainers are configured to hold a container and the base is configured to receive a container bottom. The handle includes a power source and switch for powering a first and second light source. A container gripper is coupled to the lower retainer for gripping the container. The upper and lower retainers are designed to serve as sleeves for receiving and displaying messages or designs printed or inscribed on transparent material, wherein the messages may be electronically displayed or controlled. The first light source emits a light into a container receiving area and the second light source may emit a light upwardly into the container receiving area, or downwardly toward the ground, for example.

20 Claims, 2 Drawing Sheets

U.S. PATENT DOCUMENTS 6,443,589 B1 9/2002 Lee
6,511,196 B1 1/2003 Hoy
6,520,657 B1 2/2003 DeNicola
6,553,696 B1 4/2003 Foster, Sr.
D475,577 S 6/2003 Kung
6,615,520 B2 * 9/2003 Landers et al. ..... 40/546
6,619,811 B2 * 9/2003 Wang et al. ..... 362/101
6,793,362 B2 * 9/2004 Tai ..... 362/101
2003/3021041 5/2002 Iacovino et al.
2003/0076672 A1 4/2003 Head

* cited by examiner

ILLUMINATED CONTAINER HOLDER

The present application claims priority to U.S. Provisional Application No. 60/549,179 filed by George S. Bigger on Mar. 2, 2004, which application is incorporated by reference herein.

BACKGROUND OF THE INVENTION

1. The Field of the Invention

The present invention relates generally to illuminated container holders. More specifically, the present invention relates to illuminated beverage container holders for displaying messages and providing enjoyment and entertainment to users and spectators.

2. The Relevant Art

Beverages have led the beverage industry to develop a large variety of beverage accessories, and therefore, containers, including mugs and tumblers for beverages, are available in the industry and some include illumination and illuminated messages, designs, symbols, trademarks, patterns and the like. Beverage container holders have become a common item available in a large variety of configurations. They may be solely for holding a beverage container, or they may also be used to insulate the associated beverage and its beverage container from the outside environment.

Decorated containers have also become a common item. Decorated containers have been used for hundreds, perhaps thousands, of years to identify the contents of a container, the manufacturer of the contents, the manufacturer of the container itself, and the owner of the container, as well as to make political, social, and artistic statements. While the styles of decoration have evolved over time, however, the manner of decorating containers has changed little. Specifically, the decoration has always involved either the shape of the container, painting, or printing on the side of the container. Little has been done, from the standpoint of technology, to improve upon the ancient decorating techniques.

Previous decorating techniques are no longer adequate. Unlike past times, in which a decorated container stood out. The modern world is saturated with decoration, and a decorated container no longer captures the attention it once did, no matter how artistic or clever the decoration. Supermarkets display thousands of containers, all designed to grab the attention of shoppers, while ordinary household items such as mugs and glasses can be easily manufactured to resemble the greatest artworks of the past.

While it has previously been proposed to use bulbs, light emitting diodes, and chemiluminescence, the adaptation to these ideas has changed the simple nature of a mug or container holder into a complex design with numerous pieces, circuits, and close tolerances, thus increasing manufacturing costs, and quite often, hurting the functionality of the container holder.

Accordingly, there exists in the art a need to resolve one or more of the problems heretofore mentioned as well as others not detailed herein.

SUMMARY OF THE INVENTION

The various elements of the present invention have been developed in response to the present state of the art, and in particular, in response to the problems and needs in the art that have not yet been fully solved by currently available beverage holders. Accordingly, the present invention provides for an improved illuminated container holder having all the functional aspects for holding a variety of sized and shaped beverage containers, while providing for an efficient marketing tool. Accordingly, the beverage holder comprises an upper and lower retainer, a base section, a handle, a power source, a first and second light source, transparent messages, and a gripper for gripping a variety of beverage containers.

Additional features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments thereof, which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1:
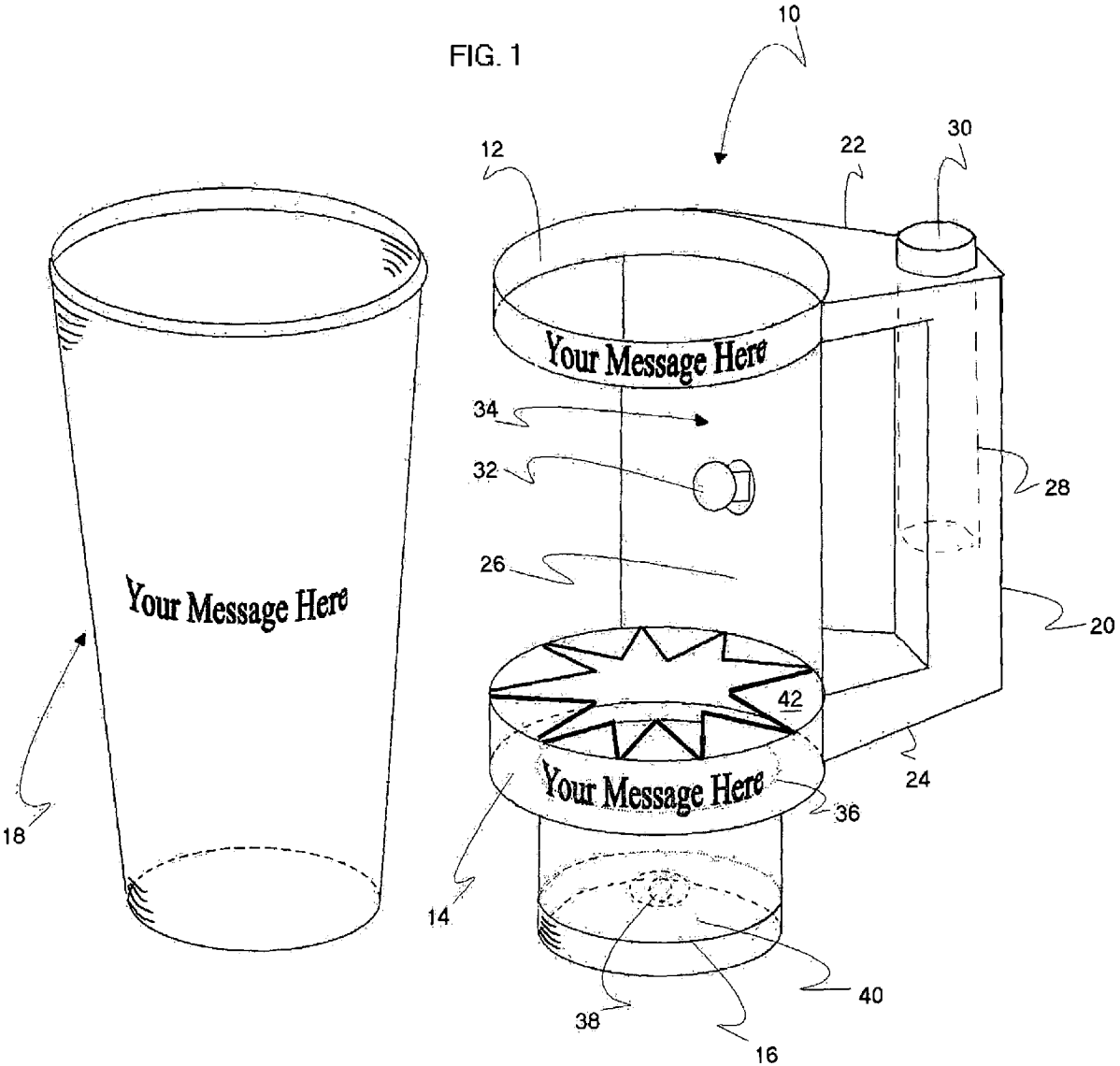
FIG. 1 illustrates one embodiment of the illuminated container holder.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

FIG. 1 illustrates one embodiment of the present invention. An illuminated container holder 10 comprises an upper retainer 12, a lower retainer 14, and a base 16 for receiving a container 18. In a preferred embodiment, the retainers 12 and 14, the base 16, and the container 18 are all made of a transparent material. An upper section 22 of the handle 20 is coupled to the upper retainer 12, and a lower section 24 of the handle 20 is coupled to the lower retainer 14. A light guard 26 is partially coupled to the upper retainer 12 on one end and the lower retainer 14 on the other.

The handle 20 includes a power source 28 integrated into the handle 20. The handle 20 also comprises a switch 30 connected to the power source 28. In this embodiment the power source 28 may be a battery, but it is recognized that any suitable form of power would be acceptable. Similarly, the switch 30, represented as a turn switch in this embodiment, may be any form of acceptable switch known in the art.

A first light source 32 protrudes out from the light guard 26 into a container receiving area 34 of the illuminated container holder 10. In another embodiment, the light guard 26 is an opaque material to guard a user from the light, or even a reflective material to direct the light toward the container receiving area 34.

A ledge, or horizontal ring 36, connected to a bottom side of the lower retainer 14 extends radially into the container receiving area 34. In this particular embodiment, the illuminated container holder 10 is designed to accept containers 18 generally having larger than average diameters on top of the ledge 36, and designed to accept containers 18 having smaller than average diameters into the base 16.

In another embodiment, the base 16 comprises a second light source 38 protruding through a floor 40 into the container receiving area 34. In this embodiment the floor 40 is an opaque material to prevent light from escaping or a reflective material to direct the light, or a combination of both. In another embodiment the second light source 38 protrudes outwardly, away from the container receiving area 34, towards the ground, for example.

A container gripper 42 attached to the lower retainer 14 is configured to receive the container 18 and apply a holding force to the outside of the container 18. The container gripper 42 may be comprised of a non-slip, gripping material to hold the container 18 in a central location within the illuminated container holder 10.

Messages are displayed to spectators, or users, on printed or inscribed material positioned in the upper retainer 12, the lower retainer 14, the base 16, or on the container 18. As discussed above, the upper and lower retainers 12 and 14, and the base 16 are preferably comprised of a transparent material to allow light from the first and second light sources, 32 and 38 respectively, to pass through. In a preferred embodiment, the messages are also printed or inscribed on transparent material. The messages may be printed or inscribed onto inserts that may be inserted into the retainers 12 and 14 or the print or inscription may be permanent. The message may be electronically displayed and/or controlled. The inserts may be of any shape or size configured to function with the container, for example, the inserts may include, but are not limited to cylinders or rounded panel inserts.

Figure 2:
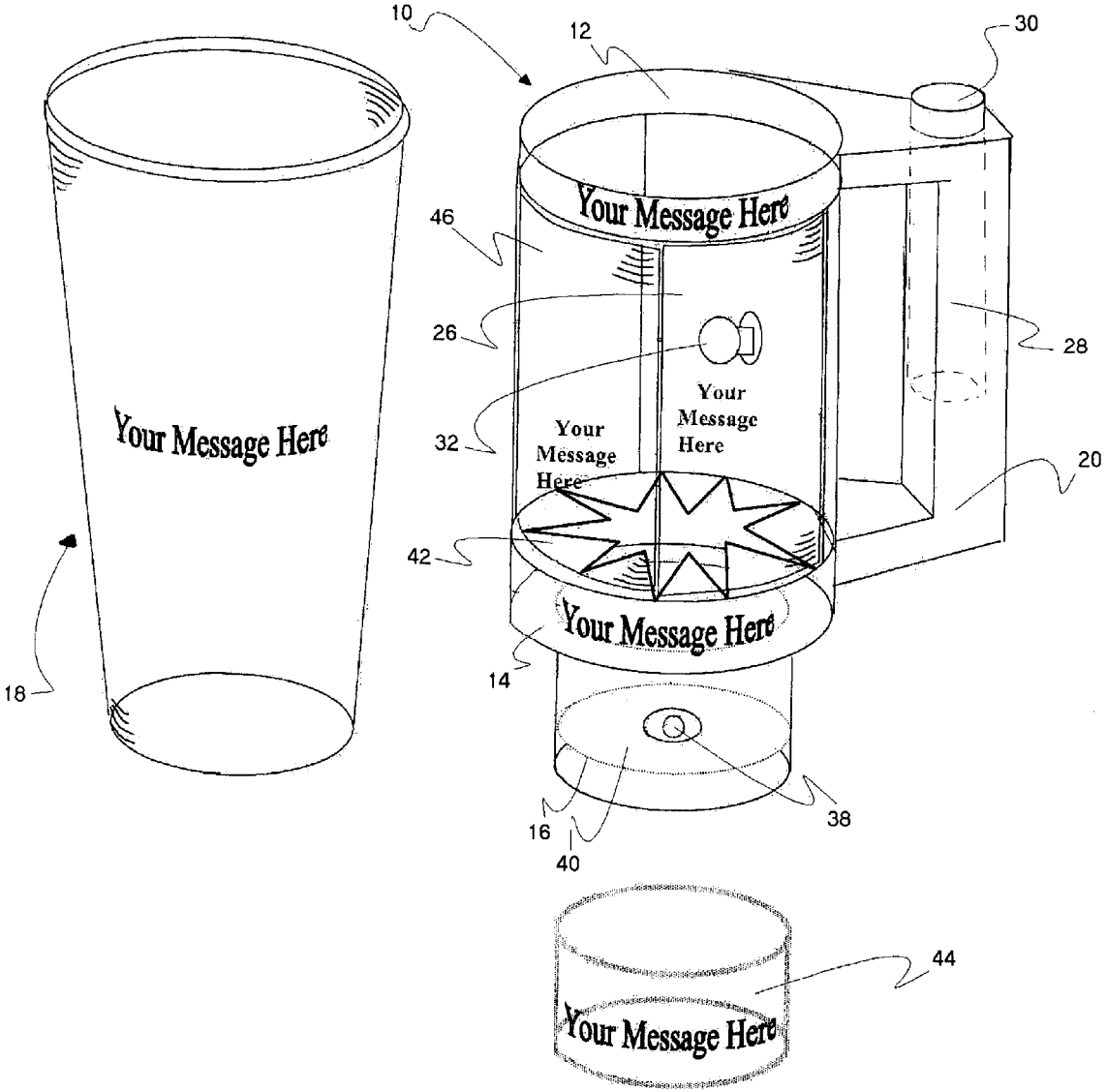
FIG. 2 illustrates another embodiment of the illuminated container holder having an attachable display sleeve.

FIG. 2 illustrates another embodiment of the illuminated container holder 10. In this embodiment, the base 16 is configured to receive a sleeve 44 indicating a particular message. To increase the aesthetic appearance and advertising appeal, the sleeve 44 is also constructed of a transparent material. The sleeve 44 may be a cylinder or rounded panel designed to integrate with the holder and may be temporarily or permanently mounted to the holder.

Additionally, the illuminated container holder 10 is configured to receive message inserts 46 into the container receiving area 34. In this embodiment, message inserts 46 are inserted into the container receiving area 34 before a container 18 is inserted into the container receiving area 34. The container 18 may be designed to secure the message inserts 46 within the illuminated container holder 10, or they may be designed to press the message inserts 46 against the inner sides of the upper and lower retainers 12 and 14. In another embodiment, the message inserts 46 are configured to attach directly to the outside surface of the container 18. It is preferred that the message inserts 46 be transparent.

Also, in one embodiment, the invention may be constructed of durable material wherein couplings between parts are configured to be sturdy. Therefore the embodiment may be configured for uses such as camping, hiking, construction, or any other environment wherein there is a premium on durability and sturdiness.

It is understood that the above-described arrangements are only illustrative of the application of the principles of the present invention. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. An illuminated container holder comprising:

an upper and lower retainer, for supporting a container;

a base, having an outer and an inner side, for supporting a container;

a first light guard partially connecting the upper and lower retainers, having a first light source protruding therefrom;

a second light guard communicating with the inner side of the base, having a second light source protruding therefrom;

a handle, having a top end attached to the upper retainer, and a lower end attached to the lower retainer, wherein the handle includes a power source; and a gripping means coupled to the lower retainer, for gripping onto container.

2. The illuminated container holder of claim 1, wherein the upper and lower retainers are transparent sleeves for receiving printed or graphic information.

3. The illuminated container holder of claim 1, wherein the base is transparent and configured to receive a transparent sleeve.

4. The illuminated container holder of claim 3, wherein the base is cylindrical in shape and configured to fit in a standard cup holder.

5. The illuminated container holder of claim 1, wherein the first light source directs a light away from the handle, and out of the container holder.

6. The illuminated container holder of claim 1, wherein the second light guard serves as a false bottom.

7. The illuminated container holder of claim 1, wherein the second light source directs a light away from the container holder, so as to shine towards the ground.

8. The illuminated container holder of claim 1, further comprising a switch on the handle.

9. The illuminated container holder of claim 8, wherein the switch is activated when a user squeezes the handle.

10. The illuminated container holder of claim 1, further comprising a ledge, directed inwardly, secured to a lower end of the lower retainer and secured to an upper end of the base.

11. The illuminated container holder of claim 1, wherein the gripping means is configured to retain multiple sized beverage containers.

12. The illuminated container holder of claim 1, wherein the light guard is reflective or opaque.

13. The illuminated container holder of claim 1, further comprising a transparent container having printed or graphic information thereon.

14. An illuminated container holder comprising:

an upper and lower retainer;

a base, having an upper, outer, and an inner side;

a container having a top, a bottom, an outer side, and an inner side, wherein the top is coupled to the upper retainer, the bottom is coupled to a ledge, and the outer side touches the upper retainer;

a first light guard partially connecting the upper and lower retainers, having a first light source protruding therefrom;

at least one sleeve positioned between the outer side of the container and inner sides of the retainers;

a second light guard communicating with the inner side of the base, having a second light source protruding therefrom;

a handle, having a top end attached to the upper retainer, and a lower end attached to the lower retainer, wherein the handle comprises a power source; and a cup gripper coupled to the lower retainer.

15. The illuminated container holder of claim 14, wherein the container is removable.

16. The illuminated container holder of claim 14, wherein the container is permanent.

17. The illuminated container holder of claim 14, wherein the container is transparent.

18. The illuminated container holder of claim 14, wherein the sleeve slips in from a top of the illuminated container holder.

19. The illuminated container holder of claim 14, wherein the sleeve attaches to the outer side of the container.

20. The illuminated container holder of claim 14, wherein the sleeve is transparent.

* * * * *